US005411854A

United States Patent [19]

Brust et al.

[11] Patent Number: 5,411,854

[45] Date of Patent: May 2, 1995

[54] SENSITIVITY INCREASE FROM ALKYNYLAMINEAZOLE, SENSITIZING DYE, AND CHALCOGENAZOLIUM SALT ADDED BEFORE HEAT CYCLE

[75] Inventors: Thomas B. Brust; Robert J. Newmiller, both of Webster, N.Y.

[73] Assignee: Eastman Kodak Company, Rochester, N.Y.

[21] Appl. No.: 174,998

[22] Filed: Dec. 29, 1993

[51] Int. Cl.[6] ..... G03C 1/16; G03C 1/18; G03C 1/28; G03C 1/34

[52] U.S. Cl. ..... 430/572; 430/583; 430/588; 430/600; 430/603; 430/605; 430/614

[58] Field of Search ..... 430/583, 588, 600, 603, 430/605, 614, 572

[56] References Cited

U.S. PATENT DOCUMENTS

| | | | |
|---|---|---|---|
| Re. 31,514 | 1/1984 | Jager et al. | 430/372 |
| T104,903 | 12/1984 | Lok et al. | 260/239 R |
| 2,131,038 | 9/1938 | Brooker et al. | 95/7 |
| 3,910,791 | 10/1975 | von Konig et al. | 96/76 R |
| 4,256,830 | 3/1981 | Jager et al. | 430/372 |
| 4,277,557 | 7/1981 | Jager et al. | 430/446 |
| 4,378,426 | 3/1983 | Lok et al. | 430/614 |
| 4,451,557 | 5/1984 | Lok et al. | 430/614 |
| 4,471,044 | 9/1984 | Parton et al. | 430/217 |
| 4,576,905 | 3/1986 | Gunther et al. | 430/401 |
| 4,578,348 | 3/1986 | Freeman et al. | 430/614 |
| 4,626,500 | 12/1986 | Sato et al. | 430/617 |
| 4,661,438 | 4/1987 | Przyklek-Elling et al. | 430/423 |
| 4,677,202 | 6/1987 | Przyklek-Elling et al. | 544/1 |
| 4,772,715 | 9/1988 | Gunther et al. | 548/100 |
| 4,780,399 | 10/1988 | Urata | 430/583 |
| 4,801,520 | 1/1989 | Inoue et al. | 430/378 |
| 4,831,136 | 5/1989 | Gunther et al. | 544/1 |
| 4,859,579 | 8/1989 | Hirano et al. | 430/598 |
| 4,874,866 | 10/1989 | Gunther et al. | 548/100 |
| 4,877,723 | 10/1989 | Hirano et al. | 430/598 |
| 4,966,836 | 10/1990 | Inoue et al. | 430/598 |
| 4,968,596 | 11/1990 | Inoue et al. | 430/598 |
| 4,973,546 | 11/1990 | Kaneko et al. | 430/551 |
| 4,981,780 | 1/1991 | Inoue et al. | 430/598 |
| 5,015,561 | 5/1991 | Hayashi et al. | 430/487 |
| 5,017,464 | 5/1991 | Nishijima et al. | 430/551 |
| 5,030,553 | 7/1991 | Kuwashima et al. | 430/598 |
| 5,061,614 | 10/1991 | Takada et al. | 430/569 |
| 5,061,615 | 10/1991 | Kase et al. | 430/569 |
| 5,128,238 | 7/1992 | Nakazyo et al. | 430/378 |
| 5,176,991 | 1/1993 | Jones et al. | 430/569 |

*Primary Examiner*—Janet C. Baxter
*Attorney, Agent, or Firm*—Paul A. Leipold

[57] ABSTRACT

The invention is accomplished by providing a combined process of chemical and spectral sensitization comprising providing a silver halide emulsion, adding a sulfur or gold chemical sensitizer, adding a finish modifier

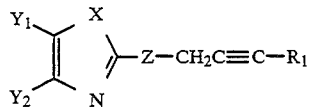

wherein X is —O—, —S—, —Se—, $$-\overset{R}{N}-;$$

$Y^1$ and $Y^2$ individually represent hydrogen or an aromatic nucleus or together represent the atoms completing a fused aromatic nucleus;

$$Z \text{ is } -CH_2\overset{R}{N}- \text{ or } -\overset{R}{N}-;$$

R is hydrogen or lower alkyl of from 1 to 5 carbon atoms; and $R_1$ is a hydrogen or methyl, provided that $Y^1$ and $Y^2$ individually represent hydrogen or an aromatic nucleus when $R_1$ is hydrogen, adding dye, and adding a hydrolyzable quaternized chalcogenazolium salt of a middle chalcogen, heating to a temperature sufficient to cause sensitization of said silver halide to take place, and cooling to recover the sensitized emulsion.

13 Claims, No Drawings

SENSITIVITY INCREASE FROM ALKYNYLAMINEAZOLE, SENSITIZING DYE, AND CHALCOGENAZOLIUM SALT ADDED BEFORE HEAT CYCLE

FIELD OF THE INVENTION

This invention relates to the preparation of silver halide emulsions for photographic use. It more particularly relates to a sensitizing process for silver halide emulsions.

BACKGROUND OF THE INVENTION

The demand for films of higher sensitivity with reduced granularity dictates the need to make more sensitive silver halide emulsions without increasing the size of the silver halide crystals that make up the emulsion. This requires the crystals to be designed and sensitized so that they require fewer photons to render them developable by an appropriate developing agent. This is commonly referred to as increased photoefficiency.

Presently, emulsions of high photoefficiency can be produced from a wide variety of grain morphologies and halide structures by treating them with a temperature cycle in the presence of compounds that liberate sulfur and gold on the surface of the silver halide crystals. This process is commonly referred to as sulfur and gold chemical sensitization and is well known in the art. The sulfur and gold sensitization is often done in the presence of spectral sensitizing dyes which induce sensitivity at longer wavelengths than the silver halide can intrinsically absorb. These sensitizing dyes, along with other heterocyclic aromatic compounds, also influence the chemical sensitization process by controlling fog and allowing higher sensitivity to be achieved without high fog.

Most light recording silver halide used for photography are deficient in blue light sensitivity relative to green and red light sensitivity, and thus obtaining the high blue light sensitivity that is needed for camera speed materials with ISO film speeds of 400 or greater will demand large silver halide crystals sensitized to the limit of available technology. Currently these extremely high blue sensitivities are achieved by low aspect ratio twinned emulsions with high bulk iodide levels and often contain internal phases that are near the saturation limit of iodide in the bromide face centered cubic lattice. Recently high aspect ratio emulsions with low bulk iodide levels have been used in blue sensitive layers of high speed negative film. These emulsions are sensitized with traditional sulfur plus gold sensitizations which include blue sensitizing dye at levels proportional to the specific surface area of the emulsion.

Acetylenic derivatives of 2-aminobenzoxazole are highly effective latent image stabilizers according to Lok et al. in U.S. Pat. Nos. 4,378,426 and 4,451,557. Fresh speed increase was also indicated, but the primary advantage was for latent image keeping (LIK), where the acetylenic compounds are preferably added during the coating process, although addition during the finish is suggested. These results and conclusions were based on a non-spectrally sensitized AgBr octahedra.

PROBLEM TO BE SOLVED BY THE INVENTION

The prior art emulsions and the sensitization methods would not produce the improved speed/granularity ratios necessary for high speed (greater than ISO 400) color negative applications. This is an especially important consideration for blue light sensitivity because most emulsion sensitization combinations cannot achieve the high blue speeds regardless of how large the crystals are made. Therefore, any new sensitization process that greatly improves sensitivity, and particularly blue light sensitivity of large high speed emulsions, is of great value.

SUMMARY OF THE INVENTION

An object of the invention is to overcome disadvantages of prior silver halide finishing methods.

Another object of the invention is to provide high speed emulsions with improved finishes.

These and other objects of the invention are generally accomplished by providing a combined process of chemical and spectral sensitization comprising providing a silver halide emulsion, adding a sulfur or gold chemical sensitizer, adding a finish modifier

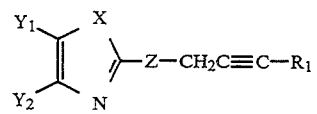

wherein

X is —O—, —S—, —Se—, or $$-\overset{R}{N}-;$$

$y^1$ and $y^2$ individually represent hydrogen or an aromatic nucleus or together represent the atoms completing a fused aromatic nucleus;

$$Z \text{ is } -CH_2\overset{R}{N}- \text{ or } -\overset{R}{N}-;$$

R is hydrogen or lower alkyl of from 1 to 5 carbon atoms; and $R_1$ is a hydrogen or methyl, provided that $y^1$ and $y^2$ individually represent hydrogen or an aromatic nucleus when $R_1$ is hydrogen, adding dye

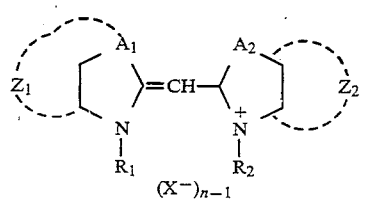

II wherein $A_1$ and $A_2$ are —O—, —S—, —Se—, $Z_1$, and $Z_2$ each is a group of non-metallic atoms necessary to complete a substituted or unsubstituted benzene or fused aromatic ring, $R_1$ and $R_2$ are sulfoalkyl or carboxyalkyl groups, and $X^-$ is an anion where n is 1 or 2, provided n is 1 when an intramolecular salt is formed, or dye

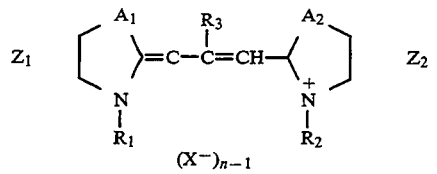

III wherein $A_1$ and $A_2$ are —O—, —S—, —Se—, $Z_1$, and $Z_2$ each is a group of non-metallic atoms necessary to complete a substituted or unsubstituted benzene or fused aromatic ring, $R_1$ and $R_2$ are sulfoalkyl or carboxyalkyl groups, $R_3$ is a hydrogen atom, or a lower alkyl or aryl group, and $X^-$ is an anion where n is 1 or 2, provided n is 1 when an intramolecular salt is formed and adding a hydrolyzable quaternized chalcogenazolium salt of a middle chalcogen

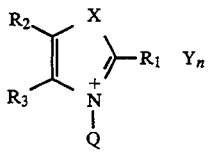

wherein $R_1$ is hydrogen, alkyl of from 1 to 8 carbon atoms, or aryl of from 6 to 10 carbon atoms; $R_2$ and $R_3$ are independently hydrogen or halogen atoms; aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(SO)_2M$ groups, wherein M is chosen to complete an aldehyde, ketone, acid, ester, thioester, amide or salt; or $R_2$ and $R_3$ together represent the atoms completing a fused ring; X is a middle chalcogen atom; Y represents a charge balancing counter ion; n is the integer 0 or 1; and Q is a quaternizing substituent having a carbon chain interrupted by a divalent group of the formula:

$$-L-T(NH-T^2)_mR^4$$

wherein:

L is a divalent linking group;

T is a carbonyl or sulfonyl;

$T^2$ is independently in each occurrence carbonyl or sulfonyl;

$R^4$ is a hydrocarbon residue or an amino group; and m is an integer from 1 to 3, heating to a temperature sufficient to cause sensitization of said silver halide to take place, and cooling to recover the sensitized emulsion.

ADVANTAGEOUS EFFECT OF THE INVENTION

It has been found that a sensitization process which incorporates the combination of an acetylenic derivative of 2-aminobenzoxazole, a carbocyanine spectral sensitizing dye, and a hydrolyzable quaternized chalcogenazolium salt, along with conventional sources of sulfur and gold added together before temperature cycling results in large increases in sensitivity such that emulsions with about half the crystal grain volume of current product emulsions are now able to provide speeds and speed/granularity ratios suitable for high speed (greater than ISO 400) color negative blue layer application.

DETAILED DESCRIPTION OF THE INVENTION

The sensitization process of the invention appears to work on a wide variety of emulsion morphologies and halide structures, but twinned emulsions containing a non-uniform high iodide phase appear to produce the highest speed while controlling fog. The emulsion morphologies include high and low aspect ratio tabular emulsions with high iodide bands or a rapidly added iodide addition from silver iodide seeds or soluble iodide salts. Multiple non-parallel twinned morphologies of lower aspect ratio which contain regions of high iodide content up to the saturation limit also show large speed increases from sensitization with the combination of this invention.

The acetylenic compounds used in the absence of either or both the blue sensitizing dye and the benzothiazolium salt will increase the blue sensitivity as stated in the prior art, but the highest blue sensitivities with the lowest fog result only from the combination with the sensitizing dye and the benzothiazolium salt and with addition prior to the heat cycle.

Prior to performing the sensitization process of the invention, the emulsion may be maintained at any suitable temperature. Typically prior to heating for sensitization, the emulsion may be held at between about 25° and about 45° C. It is preferred that the emulsion prior to heating be held at between about 35° and about 40° C. for best mixing.

The heating for sensitization may be to any temperature which allows sensitization to be completed within a reasonable time without having adverse effects upon any of the chemicals present during sensitization. Typically heating for sensitization will be to between about 50° and about 70° C. with a hold time of between about 1 and about 60 minutes. It is preferred that sensitization be carried out between about 55° and 65° C. for the most rapid sensitization without having a deteriorating effect upon the chemical structures or upon silver halide grain properties such as fogging. It is preferred that the hold for sensitization be between about 5 and about 30 minutes for complete silver halide grain sensitization without generation of fog or deterioration of the chemical compounds.

The sulfur and/or gold sensitizer, finish modifier, dye, and salt of a middle chalcogen may be added in any order desired prior to heating to finish. However, it has been found that the preferred order is to add the dye, then the sulfur and/or gold sensitizer, then the salt of a middle chalcogen, and then the finish modifier in that order for the best speed/grain and fog properties for the emulsion.

The higher speed emulsions of the invention, of greater than ISO 400, generally include emulsions of between about 400 ISO and 1600 ISO as preferred emulsions for color negative films. The emulsion speed generally may be determined by techniques such as described in U.S. Pat. No. 4,439,520, columns 53 and 54.

A preferred hydrolyzable quaternized chalcogenazolium salt is the salt:

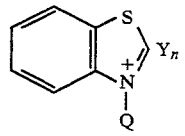

where Y represents a charge balancing counter ion; n is the integer 0 or 1; and Q is a quaternizing substituent having a carbon chain interrupted by a divalent group of the formula:

$$—L—T(NH—T^2)_mR^4$$

wherein:

L is a divalent linking group;

T is a carbonyl or sulfonyl;

$T^2$ is independently in each occurrence carbonyl or sulfonyl;

$R^4$ is a hydrocarbon residue or an amino group; and m is an integer from 1 to 3. It is preferred because of good antifoggant performance during finishing.

Any emulsion may be utilized in the sensitization process of the invention. However, the process has found a preferred use for higher speed bromoiodide tabular and non-tabular emulsions, particularly blue sensitized emulsions, as there is a need for increasing the efficiency of sensitization of such emulsion for high speed color negative films. The process produces the preferred speed grain improvement with blue and green sensitizing dyes such as set forth in Structures II and III above.

Any suitable dopants may be present in the preferred kromoiodide emulsions of the invention. Included are dopants such as zinc, rhodium, palladium, gold, platinum, ruthenium, bismuth, copper, iridium, tellurium, iron, selenium, iridium, platinum, cesium, and osmium. The metals introduced during grain nucleation and/or growth can enter the grains as dopants to modify photographic properties, depending on their level and location within the grains. When the metal forms a part of a coordination complex, such a hexacoordination complex or a tetracoordination complex, the ligands can also be occluded within the grains. Coordination ligands, such as halo, aquo, cyano, cyanate, thiocyanate, nitrosyl, thionitrosyl, oxo, and carbonyl ligands are contemplated and can be relied upon to vary emulsion properties further.

The chemical sensitizers utilized in the invention generally are the gold or sulfur sensitizers that are well known in the art. As is generally appreciated by those skilled in the art, chemical sensitizations are generally categorized as sulfur, gold, or reduction sensitizations in which active sensitizing agents containing sulfur, gold, or reducing agents capable of interacting with the grain surface are introduced. Sulfur chemical sensitization has direct analogues in selenium and tellurium chemical sensitizations. Although the term "middle chalcogen sensitization" has been employed on occasion to designate generically this class of chemical sensitization, those skilled in the art usually refer to sulfur sensitization without intending to exclude selenium and tellurium sensitizations. Similarly, gold chemical sensitizations have analogues in other Group VIII noble metal sensitizations, with the latter generally regarded as belonging in the same general category, occasionally referred to as noble metal sensitization. Again, those skilled in the art usually do not intend to exclude other noble metal sensitizations when referring nominally to gold sensitization. Combinations of two of the sulfur, gold, and reduction categories of chemical sensitizations are common. Sulfur and gold chemical sensitizations are most common in high sensitivity negative-working photographic emulsions and are preferred for this invention.

Any photographic gelatin may be utilized in any suitable amount during sensitization. Generally the amount of gelatin is between about 10 and 100 grams per mole of silver. A preferred amount is between 20 and 60 grams per mole of silver for efficient sensitization.

In proceeding from the lower temperature at which the emulsion is during addition of the sensitization materials and the elevated temperature for sensitization, heating is carried out at between about 1 and 2 degrees per minute in order to allow the mixing of the emulsion to maintain stable temperature conditions throughout the emulsion.

The bromoiodides set forth as preferred for the invention may contain between 0 and about 40% iodide. It is preferred that the bromoiodides have between 2 and 20% iodide for best performance in color negative films.

It is known that in the sensitization of silver halides, there may be other finishing addenda present to aid in formation of the uniform sensitization and to increase the rate of sensitization. Typical of such materials are sodium thiocyanate and potassium chloride.

It is known that to achieve an optimum finish, it is necessary to experiment to achieve the best combination of speed, fog, contrast, reciprocity, pressure sensitivity, latent image keeping, and raw stock keeping. This is done by varying the amounts of the materials present during sensitization to achieve the optimum balance of properties desired for the particular emulsion being sensitized. It is within the skill of the art to perform experiments to achieve this optimum sensitization.

The following examples are intended to be illustrative and not exhaustive of the performance of the invention. Parts and percentages are by weight unless otherwise noted.

EXAMPLES

Example 1

This example shows the importance of the correct level of blue sensitizing dye in combination with 2-PABO for a 9% iodide tabular emulsion with a diameter of 1.5 μm and an aspect ratio of 5.

The emulsion was prepared as follows: The first 12% was a pure bromide tabular emulsion prepared with a conventional double jet accelerated flow precipitation with pBr controlled at 1.6. The next 20% was precipitated using controlled double jet with a salt solution containing 45 mole % iodide and the pBr maintained at 1.6. The final addition was again pure bromide with pBr maintained at 1.6. The emulsion was washed with ultrafiltration.

The emulsion was finished as follows: The primitive emulsion was melted at 40° C., 60 mg/mole of sodium thiocyanate was added followed by the sensitizing dye D-1. 2.8 mg/mole of aurous dithiosulfate dihydrate and 0.56 mg/mole of sodium thiosulfate pentahydrate were then added. The benzothiazolium salt S-1 was added before the heat cycle at a level of 40 mg/mole Ag. The temperature was then raised to 65° C. and held for various times as shown below in Table I.

The finished emulsion was coated on an antihalation support at 0.9 g/m$^2$ with coupler C-1 at 1.3 g/m$^2$ and gelatin at 2.7 g/m$^2$. This was overcoated with gelatin at 3.3 g/m$^2$ and hardened with bis(vinylsulfone methylether). The film was exposed through a step wedge by a 3000 K tungsten source filtered with a daylight V and a Kodak Wratten 2B filter. The film was processed through a standard C-41 process. The speed values are linear relative to the slowest example which was given an arbitrary speed of 100.

TABLE I

| 2-PABO Level mg/mole Ag | Dye D-1 Level mmole/mole Ag | Hold Time at 65° C. | Dmin | Speed | Mean Dmin | Mean Speed |
|---|---|---|---|---|---|---|
| 2 | 0.45 | 10 | .25 | 177 | | |
| | | 20 | .45 | 135 | .46 | 148 |
| | | 30 | .68 | 135 | | |
| 0 | 0.50 | 10 | .12 | 100 | | |
| (control) | | 20 | .10 | 117 | .11 | 110 |
| | | 30 | .12 | 110 | | |
| 2 | 0.50 | 10 | .14 | 170 | | |
| | | 20 | .24 | 158 | .25 | 162 |
| | | 30 | .36 | 158 | | |
| 2 | 0.55 | 10 | .09 | 170 | | |
| | | 20 | .13 | 162 | .13 | 174 |
| | | 30 | .16 | 195 | | |

It can be seen from sensitization series in Table I that the presence of 2-PABO produces a large speed increase at a set dye level. A comparison of the Dmin and speed values shows that increasing the sensitizing dye level produces the highest speed at the lowest Dmin. The range of speed and Dmin values over the hold time series also indicates that the most robust finish is obtained at the higher dye level.

Example 2

This example shows that the butynl analog, 2-BABO, is at least as effective as the propynl analog, 2-PABO, for increasing blue sensitivity.

The emulsion precipitation and the sensitization method were identical to Example 1 except for the changes outlined in Table II. Again, 40 mg/mole of benzothiazolium salt S-1 was present and the acetylenic compounds were each added at 2.5 mg/mole. A 20-minute hold at 65° C. was used for the temperature cycle.

The emulsions were coated, exposed, and processed identically to Example 1. Speed values are relative to the slowest coating and are linearly related.

TABLE II

| Acetylenic Compound | Dmin | Speed |
|---|---|---|
| none (control) | .14 | 100 |
| 2-PABO | .14 | 174 |
| 2-BABO | .17 | 219 |

It can be seen from Table II that the 2-PABO produced a significantly higher speed than the finish without any acetylenic compound at a matched Dmin. The 2-BABO finish showed even higher speed than the 2-PABO finish with only slight Dmin increase.

Example 3

Tabular grain emulsions are of special interest in blue sensitive layers because they show intrinsically lower light scatter and high dye density yield. This example shows that 2-PABO increases the sensitivity of a high aspect ratio tabular emulsion when it is used in combination with any of the three blue spectral sensitizing dyes D-1, D-2, or D-3. Benzothiazolium salt S-1 was also present and held constant at 35 mg/mole Ag.

The 3% iodide high aspect ratio bromoiodide tabular emulsion was prepared using conventional double jet controlled pBr precipitation methods with 1.5 mole % iodide added uniformly at a pBr of 1.45 and a temperature of 60° C. for the first 70% of the precipitation. The temperature was raised to 75° C., and soluble iodide totaling 2 mole % of the total precipitated silver was then added rapidly. The pBr was then adjusted to 3.1 using a single jet of silver nitrate, and silver bromide was precipitated at this pBr to 85% of the total silver. The pBr was then adjusted to 2.1 with sodium bromide, and the final 15% was precipitated by single jet addition of silver nitrate. The emulsion was washed using ultrafiltration. The resulting emulsion was 3.1 μm in diameter and 0.12 μm thick.

The high aspect ratio tabular emulsion was sensitized using the following procedure: The primitive emulsion was melted at 40° C. 20 mg/mole of sodium thiocyanate was added followed by 1.15 mmol/mole of sensitizing dye. Aurous dithiosulfate and sodium thiosulfate were then added at levels from 2 to 3 mg/mole. 40 mg/mole benzothiazolium salt S-1 was then added followed by 3 mg/mole of 2-PABO. The temperature was then ramped to 65° C. and held for between 5 and 20 minutes followed by rapid cooling back to 40° C. and then chill set.

The finished emulsion was coated on an antihalation support at 1.6 g/m$^2$ of silver with 1.0 g/m$^2$ of coupler C-1 and 4.3 g/m$^2$ of gelatin. This was overcoated with 1.6 g/m$^2$ of gelatin and hardened using bis(vinylsulfone methylether). The coatings were exposed through a step wedge to a 3000K tungsten source filtered with a daylight V and a Kodak Wratten 2B filter. The coatings were processed in a standard C-41 process. The results are shown in Table III with the speed values relative to the slowest coating and linearly related.

TABLE III

| Sensitizing Dye | 2-PABO level | Dmin | Speed |
|---|---|---|---|
| (control) D-1 | 0 | .11 | 166 |
| D-1 | 3 | .12 | 339 |
| (control) D-2 | 0 | .17 | 166 |
| D-2 | 3 | .35 | 229 |
| (control) D-3 | 0 | .11 | 100 |
| D-3 | 3 | .22 | 158 |

Table III shows that for all three sensitizing dyes, large speed increases were observed when 2-PABO was added before the heat rise. The importance of the correct dye is also illustrated in this example by the fact that different speeds and Dmins were obtained from the different dyes.

Example 4

This example illustrates that large blue sensitivity increases are obtained when 2-PABO is included in the finish of a polymorphic multiply-twinned low-aspect-ratio, structured-iodide emulsion. This example also shows that the highest sensitivities and lowest fog are only achieved when appropriate levels of spectral sensitizing dye D-1 and benzothiazolium salt S-1 are also present along with the 2-PABO before the temperature cycle.

The emulsion was prepared as follows: A reaction vessel was charged with a gelatin solution containing sodium bromide to establish a pAg of 0.9. An extremely fine grain silver iodide emulsion was added to the gelatin solution at a level adequate to provide 15 mole % iodide in the final emulsion. A conventional double jet addition of silver nitrate and sodium bromide was conducted with an accelerated flow profile while maintaining the pBr at 0.9. When the precipitation had progressed to a point where there was adequate excess bromide to complete the precipitation, the addition of sodium bromide was stopped, and silver nitrate alone was added until a pBr of 2.3 was reached. The emulsion was then washed and concentrated using ultrafiltration.

The sensitization of the emulsion was carried out by melting the primitive emulsion at 40° C., then adding 500 mg/mole of potassium chloride, followed by 100 mg/mole sodium thiocyanate. Between 35 and 70 mg/mole of sensitizing dye D-1 was then added (when used) followed by 1.2 mg/mole of sodium thiosulfate pentahydrate and 2.4 mg/mole of aurous dithiosulfate dihydrate. Various levels of S-1 benzothiazolium salt was added followed by the 2-PABO. The temperature was then ramped to 65° C. and held between 5 and 30 minutes, followed by cooling to 40° C. and finally a chill set. The finished emulsions were coated, exposed, and processed in the same format as used in Example 3.

Part A

This set of sensitization experiments shows that the best speed/fog is obtained only when the acetylenic compound is added before the temperature cycle. The results are summarized below in Table IV.

TABLE IV

| | 2-PABO mg/mole | Addition location | 65° C. hold min. | Fog | Speed |
|---|---|---|---|---|---|
| control | 0 | — | 5 | .11 | 100 |
| control | I | after heat | 5 | .11 | 110 |
| control | 2 | after heat | 5 | .12 | 110 |
| control | 4 | after heat | 5 | .11 | 129 |
| control | 0 | after heat | 10 | .16 | 93 |
| control | 0.35 | after heat | 10 | .17 | 91 |
| control | 0.70 | after heat | 10 | .17 | 102 |
| control | 2 | after heat | 10 | .20 | 129 |
| control | 4 | after heat | 10 | .22 | 110 |
| control | 8 | after heat | 10 | .24 | 89 |
| invention | 0.35 | before heat | 5 | .17 | 162 |

The results in Table IV show that the addition of the acetylenic compound before the heat cycle requires only small amounts of the acetylenic compound to produce much higher speeds at acceptable levels of fog.

Part B

This example shows how the correct level of sensitizing dye in combination with benzothiazolium salt S-1 and 2-PABO will produce the highest speed at the lowest fog level. In these finishes, the acetylenic compound was added before the heat cycle at a level of 0.35 mg/mole. Benzothiazolium salt S-1 was also added before the 2-PABO at a level of 55 mg/mole. The data is summarized below in Table V.

TABLE V

| | D-1 dye mg/ft$^2$ | 65° C. hold time minutes | Fog | Speed |
|---|---|---|---|---|
| control 5A | 0 | 5 | .06 | 217 |
| control 5B | 0 | 10 | .18 | 260 |
| control 5C | 0 | 15 | .26 | 257 |
| 5D | 17 | 5 | .07 | 220 |
| 5E | 17 | 10 | .17 | 247 |
| 5F | 17 | 15 | .25 | 237 |
| 5G | 35 | 5 | .04 | 223 |
| 5H | 35 | 10 | .11 | 250 |
| 5I | 35 | 15 | .19 | 257 |
| invention 5J | 70 | 5 | .04 | 230 |
| invention 5K | 70 | 10 | .11 | 260 |
| invention 5L | 70 | 15 | .17 | 257 |

It can be seen from Table V that high speed is obtained without dye D-1 but only at much higher levels of fog. As the dye level is increased, fog is reduced such that when the optimum dye levels are reached 5J, 5K, and 5L, the highest speed can be attained at very low levels of fog.

ADVANTAGES SHOWN BY THE EXAMPLES

Acetylenic benzoxazole compounds added to an emulsion before the temperature cycle and in the presence of an appropriate level of a sensitizing dye and preferably a benzothiazolium salt finish modifier produce large increases in sensitivity for a wide variety of emulsions. This invention is especially valuable when applied to blue light sensitization because it allows negative films of higher overall sensitivity to be produced without being limited by the sensitivity of the blue light recording layer. It also allows films to be produced with improved speed/granularity. This is especially important when a color film is used to make a black-and-white print. In this application the blue layer granularity is weighted equally with the red and green and can cause a large degree of graininess if a large grainy blue sensitive emulsion was required to meet the blue sensitivity aim.

S-1

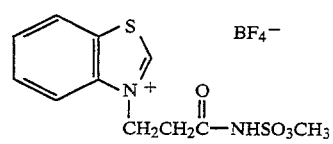

D-1

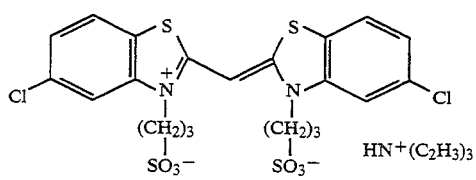

D-2

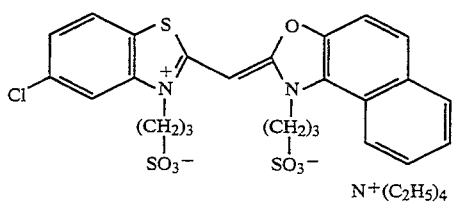

-continued

D-3

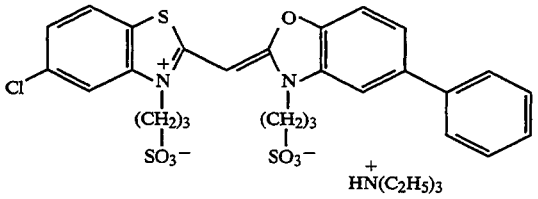

C-1

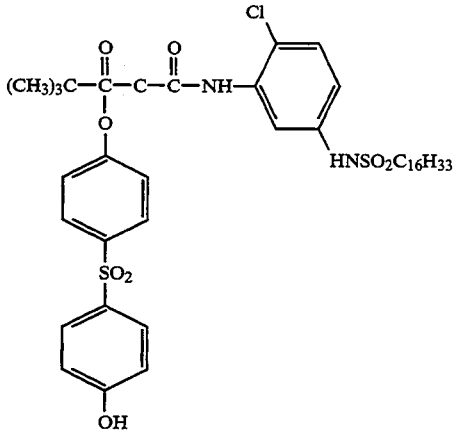

2-PABO

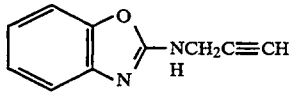

2-BABO

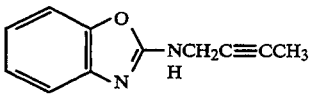

The invention has been described in detail with particular reference to preferred embodiments thereof, but it will be understood that variations and modifications can be effected within the spirit and scope of the invention.

We claim:

1. A combined process of chemical and spectral sensitization comprising providing a silver halide emulsion, adding at least one of a sulfur or gold chemical sensitizer, adding finish modifier, adding dye, and adding hydrolyzable quaternized chalcogenazolium salt of a middle chalcogen wherein said finish modifier is of the general structure

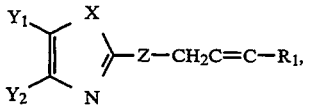

wherein X is —O—, —S—, —Se—, or $$-\overset{R}{N}-;$$

$Y^1$ and $Y^2$ individually represent hydrogen or an aromatic nucleus or together represent the atoms completing a fused aromatic nucleus;

$$Z \text{ is } -\overset{R}{CH_2N}- \text{ or } -\overset{R}{N}-;$$

R is hydrogen or lower alkyl of from 1 to 5 carbon atoms; and $R_1$ is a hydrogen or methyl, provided that $Y^1$ and $Y^2$ individually represent hydrogen or an aromatic nucleus when $R_1$ is hydrogen, said dye comprises dye II or III wherein dye II comprises

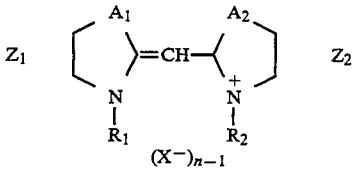

wherein $A_1$ and $A_2$ are —O—, —S—, —Se—, $Z_1$, and $Z_2$ each is a group of non-metallic atoms necessary to complete a substituted or unsubstituted benzene or fused aromatic ring, $R_1$ and $R_2$ are sulfoalkyl or carboxyalkyl groups, and $X^-$ is an anion where n is 1 or 2, provided n is 1 when an intramolecular salt is formed, and dye III comprises

[III]

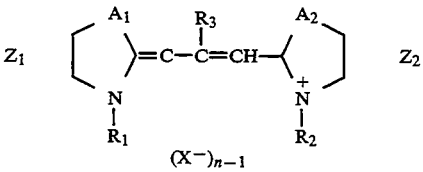

wherein $A_1$ and $A_2$ are —O—, —S—, —Se—, $Z_1$, and $Z_2$ each is a group of non-metallic atoms necessary to complete a substituted or unsubstituted benzene or fused aromatic ring, $R_1$ and $R_2$ are sulfoalkyl or carboxyalkyl groups, $R_3$ is a hydrogen atom, or a lower alkyl or aryl group, and $X^-$ is an anion where n is 1 or 2, provided n is 1 when an intramolecular salt is formed, and said hydrolyzable quaternized chalcogenazolium salt of a middle chalcogen comprises

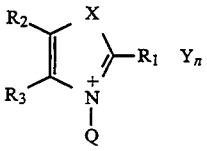

wherein $R_1$ is hydrogen, alkyl of from 1 to 8 carbon atoms, or aryl of from 6 to 10 carbon atoms; $R_2$ and $R_3$ are independently hydrogen or halogen atoms; aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(SO)_2M$ groups, wherein M is chosen to complete an aldehyde, ketone, acid, ester, thioester, amide or salt; or $R_2$ and $R_3$ together represent the atoms completing a fused ring; X is a middle chalcogen atom; Y represents a charge balancing counter ion; n is the integer 0 or 1; and Q is a quaternizing substituent having a carbon chain interrupted by a divalent group of the formula:

$$-L-T(NH-T^2)_mR^4$$

wherein:

L is a divalent linking group;

T is a carbonyl or sulfonyl;

$T^2$ is independently in each occurrence carbonyl or sulfonyl;

$R^4$ is a hydrocarbon residue or an amino group; and m is an integer from 1 to 3, heating to a temperature sufficient to cause sensitization of said silver halide to take place, and cooling to recover the sensitized emulsion wherein the order of addition comprises dye, then said at least one of sulfur and gold, then said salt of a middle chalcogen and then said finish modifier.

2. The process of claim 1 wherein prior to heating said emulsion has a temperature between about 25° to about 45° C.

3. The process of claim 2 wherein said temperature prior to heating is about 35° to about 40° C.

4. The process of claim 1 wherein said heating for sensitization is to a hold temperature of between about 50° and 70° C.

5. The process of claim 4 wherein said heating is to a hold temperature of between about 55° and 65° C.

6. The process of claim 4 wherein said heating is to between 50° and 70° C. for a hold time of between about 1 and about 60 minutes.

7. The process of claim 6 wherein said time is between about 5 and about 30 minutes.

8. The process of claim 1 wherein said finish modifier comprises

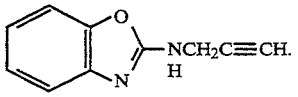

9. The process of claim 1 wherein said finish modifier comprises

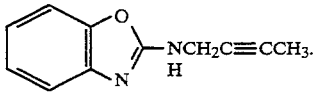

10. The process of claim 1 wherein said dye comprises dye II.

11. The process of claim 1 wherein said hydrolyzable quaternized benzothiazolium salt comprises

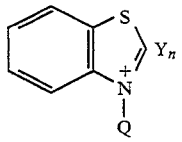

where Y represents a charge balancing counter ion; n is the integer 0 or 1; and Q is a quaternizing substituent having a carbon chain interrupted by a divalent group of the formula:

$$-L-T(NH-T^2)_mR^4$$

wherein:

L is a divalent linking group;

T is a carbonyl or sulfonyl;

$T^2$ is independently in each occurrence carbonyl or sulfonyl;

$R^4$ is a hydrocarbon residue or an amino group; and m is an integer from 1 to 3.

12. The process of claim 1 wherein said dye comprises

D-1

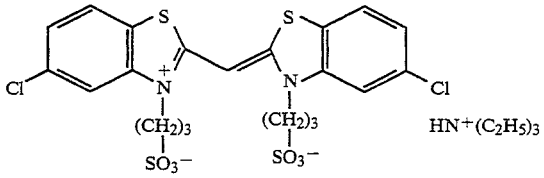

D-2

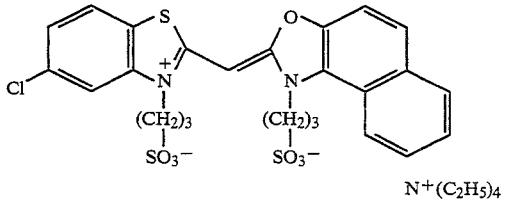

or

D-3

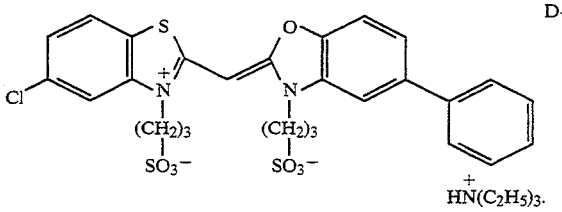

13. The process of claim 1 wherein said heating is at a rate of about 1° to 2° C. per minute.

* * * * *